US005551321A

United States Patent [19]

Bottiglieri

[11] Patent Number: 5,551,321

[45] Date of Patent: Sep. 3, 1996

[54] SOCKET HAVING NUT STORAGE MAGAZINE

[76] Inventor: Peter Bottiglieri, 20841 Stoney Avenue, Maple Ridge, British Columbia, Canada, V2X 7T2

[21] Appl. No.: 453,966

[22] Filed: May 30, 1995

[51] Int. Cl.[6] ..... B25B 13/02

[52] U.S. Cl. ..... 81/125

[58] Field of Search ..... 81/124.1, 125

[56] References Cited

U.S. PATENT DOCUMENTS 1,490,739 4/1924 Hewitt .
2,605,666 8/1952 Jorgensen et al. .
2,811,883 11/1957 Cleaves .
2,857,794 10/1958 Red .
2,895,360 7/1959 Madsen .
2,896,489 7/1959 Madsen .
3,063,316 11/1962 Salierno .
4,535,657 8/1985 Farris .
4,724,731 2/1988 Onofrio .
5,335,569 8/1994 Rowley ..... 81/125

*Primary Examiner*—James G. Smith
*Attorney, Agent, or Firm*—Merchant, Gould, Smith, Edell, Welter & Schmidt, P.A.

[57] ABSTRACT

A socket for attachment to a drive wrench for unfastening nuts from bolts has a bore leading from a socket head into a chamber which receives and holds a plurality of nuts that are unfastened by the socket. An aperture in the side wall of the socket permits removal of the nuts from the chamber. A removable sleeve fits over the socket to cover the aperture.

6 Claims, 1 Drawing Sheet

SOCKET HAVING NUT STORAGE MAGAZINE

FIELD OF THE INVENTION

The application pertains to a socket for use with a drive wrench for unfastening nuts from bolts, having a chamber for storing a plurality of nuts.

BACKGROUND OF THE INVENTION

Using a conventional socket wrench, it is necessary after each nut is unfastened to remove the nut from the socket head before using the socket on another nut. It is convenient to provide storage means within the socket so that the nuts can be retained in it until a number of them have been removed, in order to speed up the task of unfastening the nuts and eliminate the need for manually handling each nut as it is unfastened. Socket wrenches which hold one or more nuts within the body of the tool are known, for example U.S. Pat. No. 2,811,883 (Cleaves), U.S. Pat. No. 3,063,316 (Salierno), U.S. Pat. No. 2,857,794 (Red), U.S. Pat. No. 2,895,360 (Madsen) and U.S. Pat. No. 2,896,489 (Madsen). However, the prior art does not disclose a socket which stores unfastened nuts and provides for the rapid and convenient removal of the nuts through a closable aperture in the storage chamber. The present invention provides such a device.

SUMMARY OF THE INVENTION

In accordance with the preferred embodiment, the invention provides a socket for use with a drive wrench in unfastening nuts from bolts. The socket has a generally cylindrical body with a chamber therein for receiving and holding the unfastened nuts. There is means at one end of the socket for attachment to a drive wrench. There is a socket head at the other end having an axial bore which leads into the chamber within the socket. Nuts unfastened by the socket head can move into the body of the socket through the axial bore and into the chamber. An aperture is provided through the side of the body into the chamber to permit removal of the nuts. Means are provided for covering the aperture. Preferably, the covering means is a removable sleeve which fits over the body of the socket. Preferably, the socket includes means for releasably holding the sleeve on the body.

DETAILED DESCRIPTION OF THE PREFERRED EMBODIMENT

Figure 1:
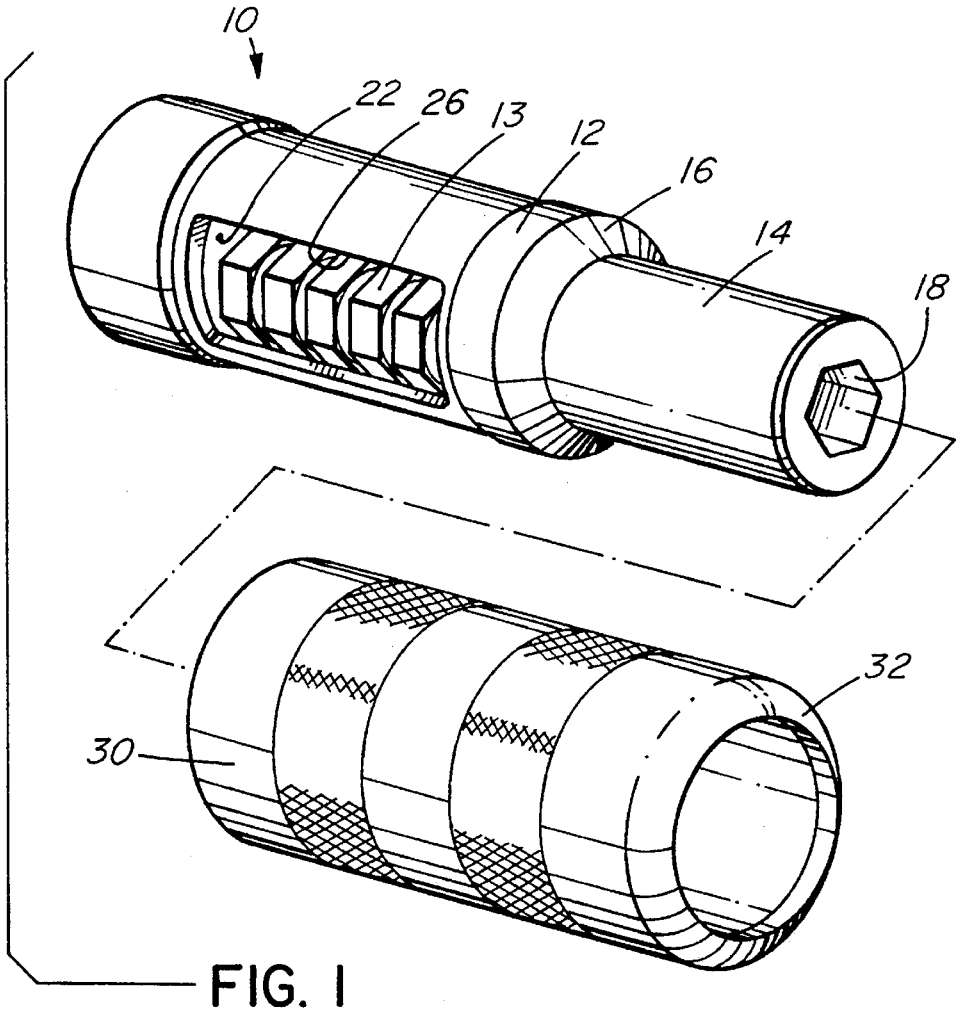
FIG. 1 is a perspective view of a socket according to the invention with the sleeve detached therefrom, with a plurality of nuts stored in the socket.

The socket 10 has a generally cylindrical body 12 with a socket head 14 extending longitudinally from one end. The outer diameter of the body 12 is larger than that of socket head 14, forming circumferential shoulder 16. The socket head 14 has an internal axial bore 18. The walls of the bore 18 that are adjacent to the open end of the socket head 14, are configured in conventional hexagonal shape to fit a nut of a selected size. The section of the axial bore which is adapted to grip a nut terminates at a shoulder 20. Inwardly of shoulder 20 there is a section 15 of the axial bore 18 which is sufficiently large in diameter to permit the free movement of nuts inwardly therethrough.

The body 12 has an internal chamber 22 which extends longitudinally in the body 12. The axial bore 18 extends into the body 12 to a shoulder 24 and opens into the internal chamber 22. The internal diameter of the chamber 22 is sufficiently large that nuts can be received into and removed from the chamber 22 without jamming, even if the nuts are contaminated with rust, grime or paint. FIG. 1 illustrates the stored nuts 13 in parallel, stacked orientation in the chamber 22, but for relatively smaller nuts, there is sufficient clearance between the nuts and the inner walls of the chamber 22 that the nuts can assume random orientations within the chamber 22. The chamber 22 is sufficiently large to hold a desired number of detached nuts.

The body 12 has a longitudinally-extending aperture 26 in the wall thereof opening into the chamber 22. The aperture 26 is sufficiently large to permit nuts 13 in the chamber to be easily removed therethrough, without jamming. Preferably, the aperture 26 is sufficiently long and wide to permit several nuts 13 to be removed at the same time, by turning the socket so that the aperture 26 is downward and the nuts 13 fall out through the aperture 26.

Figure 2:
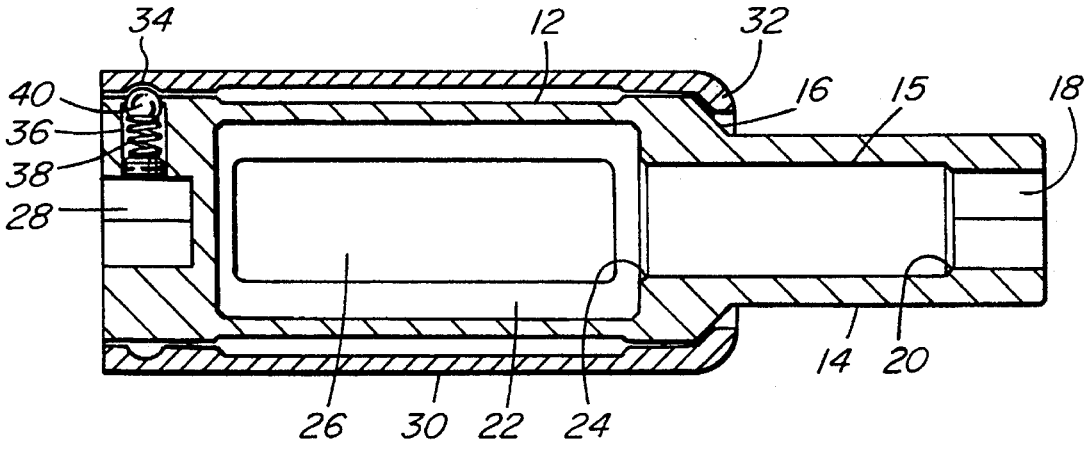
FIG. 2 is a longitudinal cross-section through the socket.

Referring to FIG. 2, at the end of the body 12 opposite to the socket head 14, there is provided a receptacle 28 to receive the driving head of a wrench (not illustrated). The receptacle 28 is square in cross-section to receive a conventional square driving head. The wrench may be either a power-driven or a manual tool.

A sleeve 30 is used to cover the aperture 26 to retain nuts in the chamber 22 until it is desired to remove the nuts. Sleeve 30 is generally cylindrical and hollow and is configured to fit snugly over the body 12. Sleeve 30 has a circumferential lip 32 at one end thereof extending inwardly, which abuts the shoulder 16 of the body 12 when the sleeve 30 is installed on the body 12. Adjacent the opposite end of the sleeve there is a circumferential groove 34 on the sleeve's inner surface. As shown in FIG. 2, a conventional detent mechanism is provided in the body 12 to engage the groove 34 in the sleeve 30. It comprises an axial bore 36 in the body 12 with a spring 38 and ball 40 therein. The ball 40 is urged upward by the spring 38 to protrude beyond the outer surface of the body 12 and engage the groove 34 in the sleeve 30, holding the sleeve 30 in position on the body 12. The sleeve 30 is removed from the body 12 by pushing it axially towards the socket head 14, disengaging the ball 40 from the groove 34.

In use, as each nut is removed from a bolt by the socket, the nut pushes the preceding nuts inwardly through the bore 18 and into the chamber 22. Nuts which are relatively large in diameter in relation to the inner walls of the chamber 22 will generally remain in stacked, parallel orientation in the chamber 22, whereas relatively smaller nuts will tumble about loosely within the chamber 22. When the desired number of nuts has been removed, the chamber 22 is emptied by pushing the sleeve 30 axially towards the socket head 14, and covering the aperture 26, permitting the nuts to fall out through the aperture 26.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A socket for use in unfastening nuts from bolts comprising:

(a) a generally cylindrical body having a first end and a second end, said body having a chamber therein for receiving and holding a plurality of said nuts;

(b) means at said first end for attachment to a drive wrench;

(c) a socket head at said second end having an axial bore therein with inner walls adjacent said second end configured to fit over and engage a nut, said bore extending into said chamber and permitting nuts unfastened by said socket to move through said axial bore into said chamber;

(d) an aperture through a side of said body into said chamber whereby nuts in said chamber may be removed therefrom; and (e) means for covering said aperture.

2. A socket according to claim 1 wherein said covering means is a removable sleeve which fits over said body.

3. A socket according to claim 2 further comprising means for releasably holding said sleeve on said body.

4. A socket according to claim 1 wherein said aperture is configured to permit simultaneous removal from said chamber of a plurality of nuts.

5. A socket according to claim 2 wherein said aperture is configured to permit simultaneous removal from said chamber of a plurality of nuts.

6. A socket according to claim 3 wherein said aperture is configured to permit simultaneous removal from said chamber of a plurality of nuts.

* * * * *